US009829826B2

(12) United States Patent
Kato et al.

(10) Patent No.: US 9,829,826 B2
(45) Date of Patent: Nov. 28, 2017

(54) DEVELOPING DEVICE AND IMAGE FORMING APPARATUS

(71) Applicant: FUJI XEROX CO., LTD., Tokyo (JP)

(72) Inventors: Masanori Kato, Kanagawa (JP); Yoshinori Tanaka, Kanagawa (JP); Tomio Ohnuki, Kanagawa (JP)

(73) Assignee: FUJI XEROX CO., LTD., Tokyo (JP)

( * ) Notice: Subject to any disclaimer, the term of this patent is extended or adjusted under 35 U.S.C. 154(b) by 10 days.

(21) Appl. No.: 14/918,922

(22) Filed: Oct. 21, 2015

(65) Prior Publication Data

US 2017/0003619 A1 Jan. 5, 2017

(30) Foreign Application Priority Data

Jun. 30, 2015 (JP) ..... 2015-130746

(51) Int. Cl.
*G03G 15/08* (2006.01)

(52) U.S. Cl.
CPC . *G03G 15/0812* (2013.01); *G03G 2215/0129* (2013.01)

(58) Field of Classification Search
CPC ..... G03G 15/081; G03G 15/0891; G03G 2221/1645
See application file for complete search history.

(56) References Cited

U.S. PATENT DOCUMENTS 4,800,411 A * 1/1989 Tanaka ..... G03G 15/0898 399/103
5,953,563 A * 9/1999 Yamaguchi ..... G03G 15/0898 399/119
5,963,563 A * 10/1999 Tomikura ..... H04H 60/25 370/486
9,046,815 B2 6/2015 Kashimoto et al.
2009/0060560 A1* 3/2009 Tamura ..... G03G 15/0815 399/92
2009/0154972 A1* 6/2009 Tanaka ..... G03G 21/105 399/358

(Continued)

FOREIGN PATENT DOCUMENTS

JP 2010-008978 A 1/2010
JP 2014-006410 A 1/2014

*Primary Examiner* — Victor Verbitsky
(74) *Attorney, Agent, or Firm* — Oliff PLC

(57) ABSTRACT

A developing device includes a housing that includes an accommodating chamber, a development opening, and a discharge opening, part of developer that is accommodated in the accommodating chamber overflowing into and being discharged from the discharge opening; a developing roller that holds and transports the developer that is supplied from the accommodating chamber; a transporting member that transports the developer in the accommodating chamber so as to supply the developer to the developing roller while stirring the developer; a regulating member that regulates a thickness of a layer of the developer that is held by the developing roller by holding back part of the developer; and a ventilation path portion that is provided so as to extend through the regulating member, the ventilation path portion being connected to a gap space that exists in a range extending to the development opening from where the developing roller passes the regulating member.

4 Claims, 10 Drawing Sheets

(56) References Cited

U.S. PATENT DOCUMENTS

2009/0269098 A1* 10/2009 Mori ..... G03G 21/206
399/94
2013/0343786 A1* 12/2013 Kashimoto ..... G03G 15/0812
399/274

* cited by examiner

DEVELOPING DEVICE AND IMAGE FORMING APPARATUS

CROSS-REFERENCE TO RELATED APPLICATIONS

This application is based on and claims priority under 35 USC 119 from Japanese Patent Application No. 2015-130746 filed Jun. 30, 2015.

BACKGROUND

Technical Field

The present invention relates to a developing device and an image forming apparatus.

SUMMARY

According to an aspect of the invention, there is provided a developing device including a housing that includes an accommodating chamber, a development opening, and a discharge opening, the accommodating chamber accommodating developer, the development opening in a portion of the accommodating chamber that faces a latent image holding member, part of the developer that is accommodated in the accommodating chamber overflowing into and being discharged from the discharge opening; a developing roller that is provided at the housing such that the developing roller rotates with a portion of the developing roller being exposed from the development opening, the developing roller holding and transporting the developer that is supplied from the accommodating chamber; a transporting member that is provided in the accommodating chamber of the housing such that the transporting member rotates, the transporting member transporting the developer in the accommodating chamber so as to supply the developer to the developing roller while stirring the developer; a regulating member that regulates a thickness of a layer of the developer that is held by the developing roller by holding back part of the developer; and a ventilation path portion that is provided so as to extend through the regulating member after extending to the regulating member from a portion of the accommodating chamber, the ventilation path portion being connected to a gap space that exists between the developing roller and the housing in a range extending to the development opening from where the developing roller passes the regulating member.

BRIEF DESCRIPTION OF THE DRAWINGS

Exemplary embodiments of the present invention will be described in detail based on the following figures, wherein.

DETAILED DESCRIPTION

Exemplary embodiments of the present invention are hereunder described with reference to the drawings.

First Exemplary Embodiment

Figure 1:
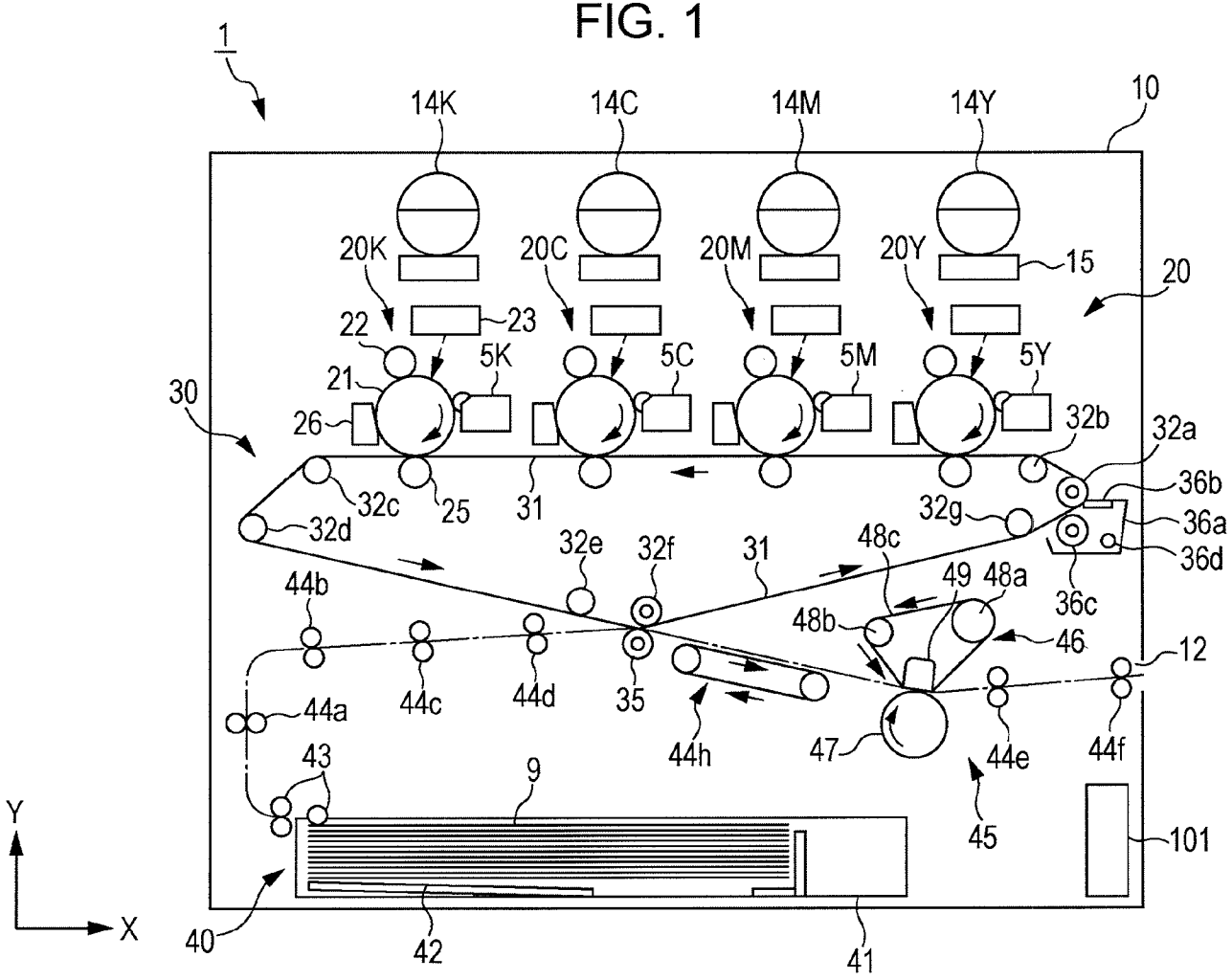
FIG. 1 is an explanatory view conceptually illustrating the entire image forming apparatus using, for example, developing devices according to, for example, a first exemplary embodiment.
Figure 2:
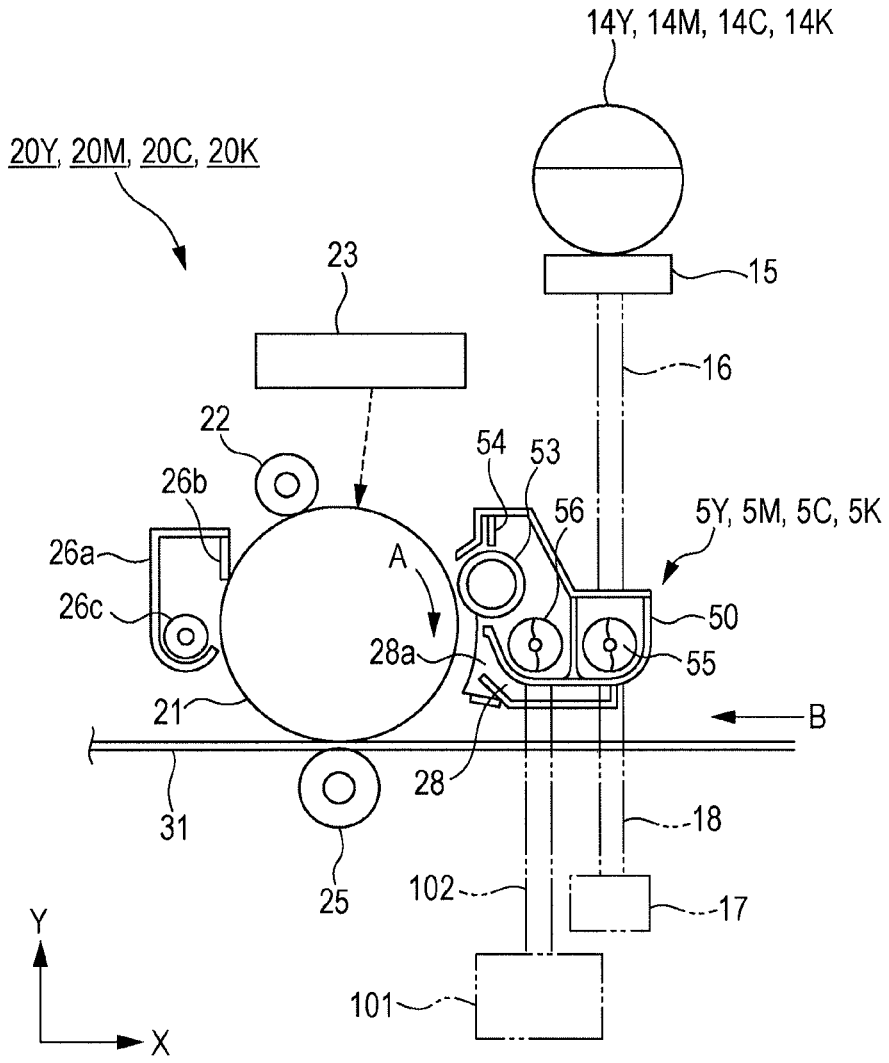
FIG. 2 is an explanatory view conceptually illustrating a portion of the image forming apparatus shown in FIG. 1.
Figure 3:
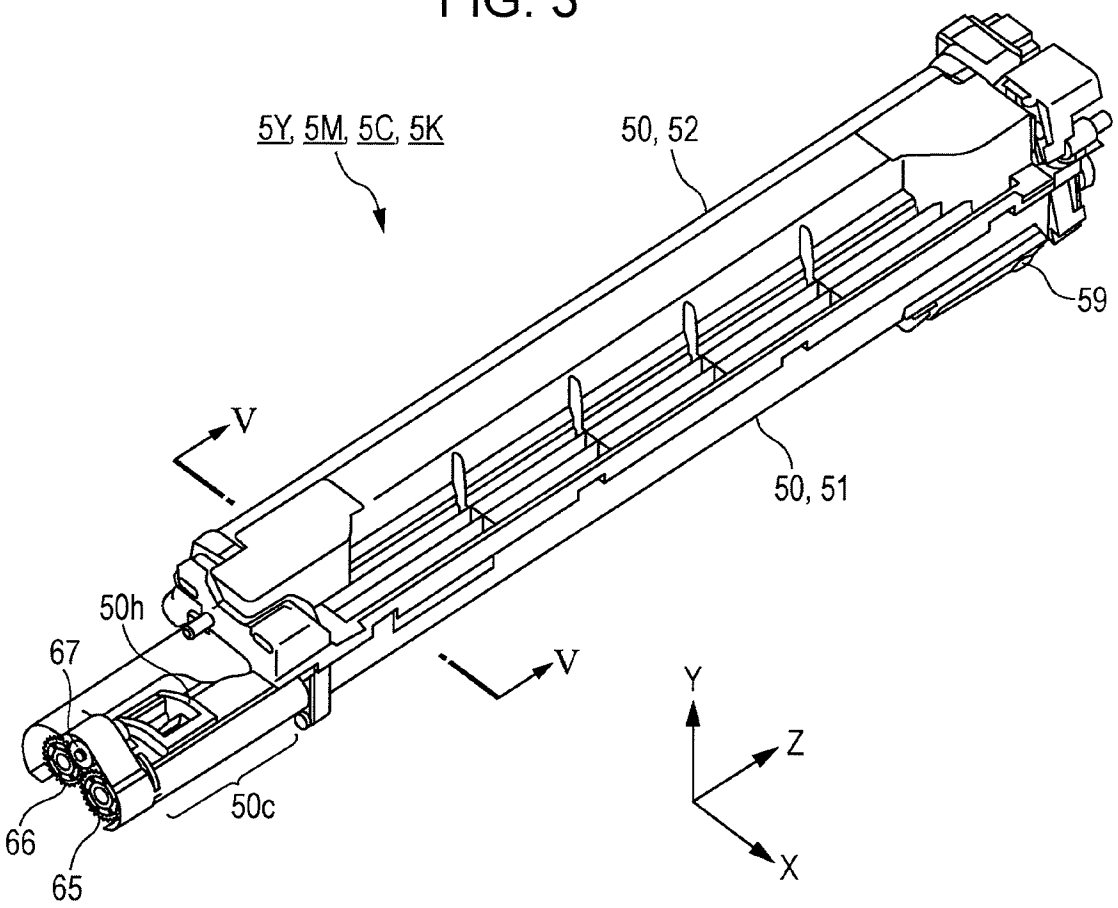
FIG. 3 is a perspective view of the entire developing device according to the first exemplary embodiment used in the image forming apparatus shown in FIG. 1.
Figure 4:
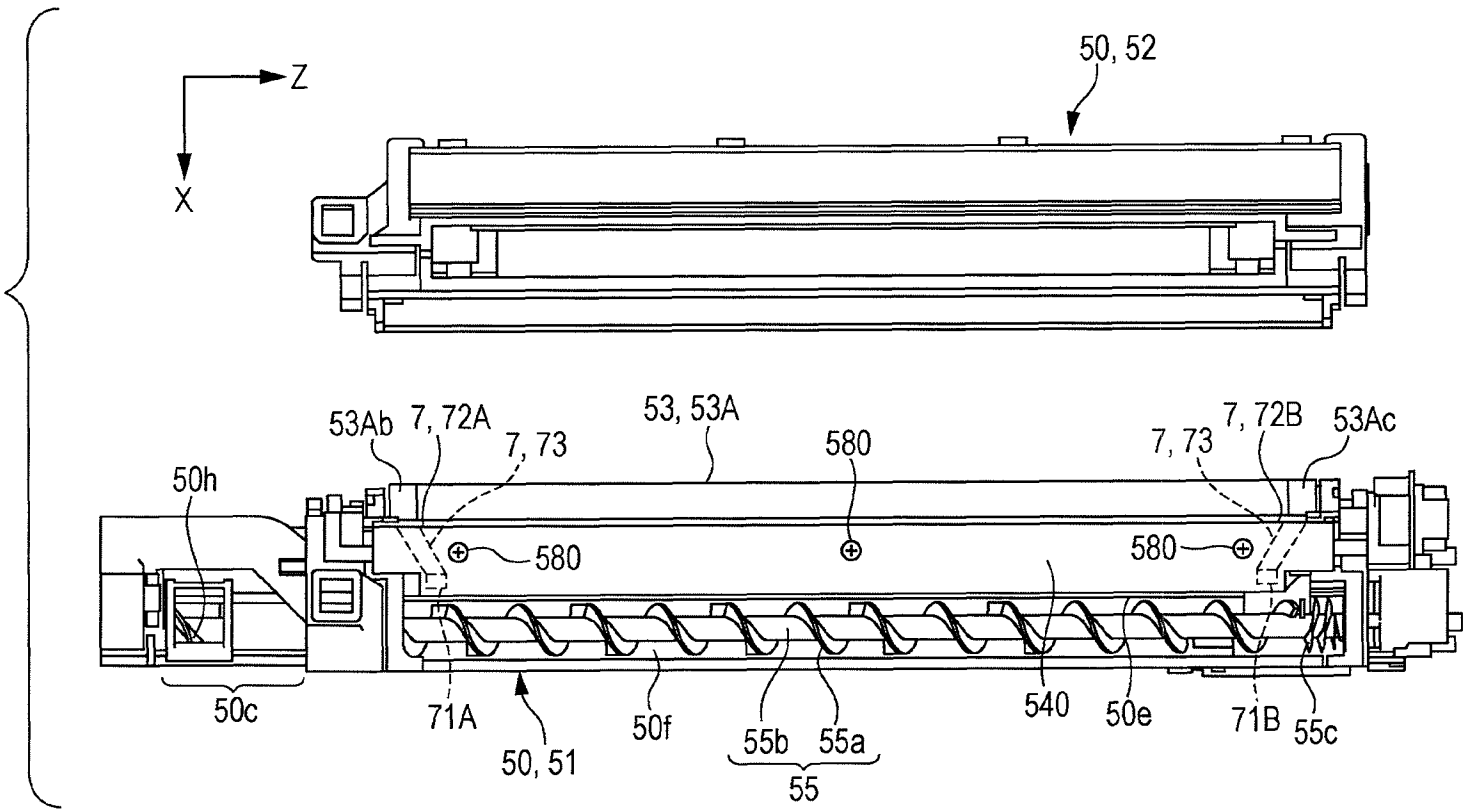
FIG. 4 is an exploded explanatory view illustrating a state of an upper housing of the developing device shown in FIG. 3 and a lower housing after removing the upper housing when seen from thereabove.
Figure 5:
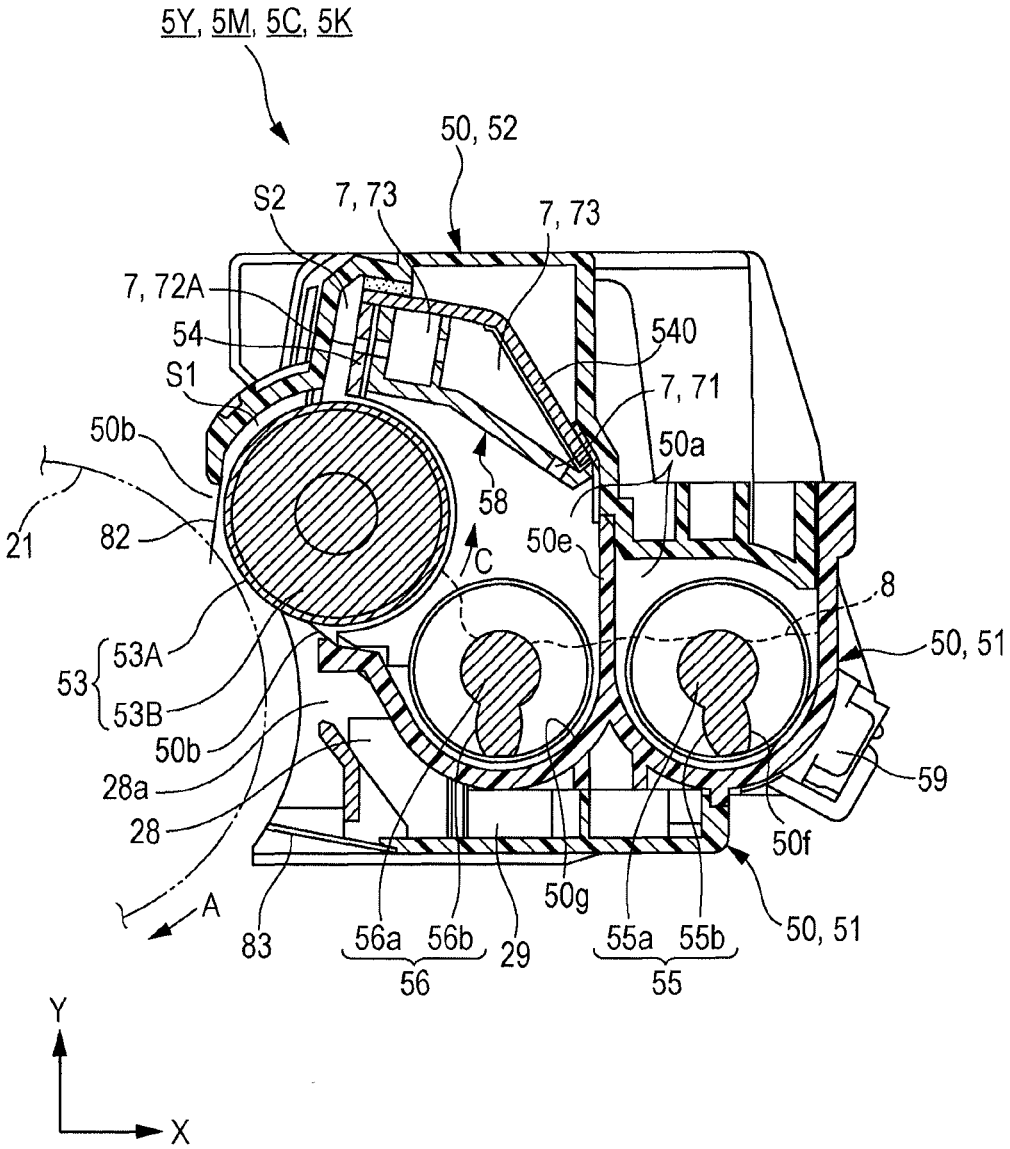
FIG. 5 is a schematic sectional view taken along line V-V of the developing device shown in FIG. 3.

FIGS. 1 to 5 illustrate an image forming apparatus 1 using developing devices 5 according to a first exemplary embodiment. FIG. 1 conceptually illustrates the entire image forming apparatus 1. FIG. 2 conceptually illustrates a portion of the image forming apparatus 1 (principally one image forming device 20 and surrounding devices thereof). FIG. 3 illustrates an appearance of the entire developing device 5. FIG. 4 illustrates a state in which a housing of the developing device 5 is divided as a result of removing a portion of the housing 10. FIG. 5 illustrates an interior of the developing device 5. Arrows X, Y, and Z that are shown in all of the figures including FIGS. 1 to 5 represent (directions along) orthogonal coordinate axes indicating a width direction, a height direction, and a depth direction presupposed in three-dimensional space in each of the figures.

Structure of Entire Image Forming Apparatus

The image forming apparatus 1 according to the first exemplary embodiment forms images formed from developer on recording paper 9, serving as an exemplary recording medium. For example, the image forming apparatus 1 is formed as a printer that receives image information that is input from an external device, such as an information terminal, and forms images. Incidentally, when the image forming apparatus 1 is provided side by side with, for example, a document reading device, the image forming apparatus 1 may be formed as a copying machine or a copying machine having facsimile functions.

The image forming apparatus 1 includes the housing 10 whose entire exterior has the shape of a box. For example, image forming devices 20, an intermediate transfer device 30, a sheet-feeding device 40, and a fixing device 45 are disposed in an internal space of the housing 10. Each image forming device 20 forms a toner image formed from toner, serving as developer. The intermediate transfer device 30 which, after the toner images formed by the image forming devices 20 have been first-transferred to and held by the intermediate transfer device 30, transports the toner images and finally transports the toner images to a second transfer position where the toner images are second-transferred to recording paper 9. The sheet-feeding device 40 accommodates and sends out the recording paper 9 that is supplied to the second transfer position of the intermediate transfer device 30. The fixing device 45 fixes the toner images second-transferred at the intermediate transfer device 30 to the recording paper 9. Here, the housing 10 is such that a supporting structural portion and an external portion are formed from, for example, a supporting member and an external cover. A discharge opening 12 through which the recording paper 9 on which the images have been formed passes for being discharged to the outside (such as an accommodation chamber) is provided in a side surface portion of the housing 10. An alternate long and short dashed line shown in FIG. 1 indicates a main transport path of the recording paper 9 in an interior of the housing 10.

The image forming devices 20 correspond to four image forming devices 20Y, 20M, 20C, and 20K that separately form developer (toner) images of four colors, that is, yellow (Y), magenta (M), cyan (C), and black (K), respectively.

Referring to FIGS. 1 and 2, the four image forming devices 20Y, 20M, 20C, and 20K each include, for example, a photoconductor drum 21, a charging device 22, a exposure device 23, a corresponding one of the developing devices 5Y, 5M, 5C, and 5K, a first transfer device 25, and a drum cleaning device 26. Each photoconductor drum 21 is rotationally driven. Each charging device 22 charges an image holding surface at an outer peripheral surface of the corresponding photoconductor drum 21 to a required potential. Each exposure device 23 forms an electrostatic latent image containing a corresponding color component by irradiating a charged image formation surface of the corresponding photoconductor drum 21 with light (indicated by a dotted arrow) whose color components Y, M, C, and K have been separated on the basis of image information. Each of the developing devices 5Y, 5M, 5C, and 5K renders visible the corresponding electrostatic latent image as a toner image of the corresponding one of the colors Y, M, C, and K by developing the corresponding electrostatic latent image as a result of supplying toner containing the corresponding color component thereto. Each first transfer device 25 first-transfers the toner image on the corresponding photoconductor drum 21 to (an intermediate transfer belt 31 of) the intermediate transfer device 30. Each drum cleaning device 26 removes and cleans off any undesired substances, such as toner, remaining on the outer peripheral surface of the corresponding photoconductor drum 21.

Each photoconductor drum 21 is, for example, a photosensitive member having the form of a drum in which an image holding surface including a photoconductor layer (photosensitive layer), formed of a photosensitive material, is formed on a peripheral surface of a cylindrical or a columnar base that is connected to ground. Each photoconductor drum 21 is provided so as to be rotationally driven in the direction of arrow A as a result of receiving power from a rotational driving device (not shown).

Each charging device 22 is, for example, a contact charging device including a contact member, such as a charging roller, that is disposed while in contact with at least the image holding surface of the corresponding photoconductor drum 21 and to which charging bias is supplied. As each charging device 22, a non-contact charging device, such as a corona discharger, may be used. When each developing device 5 is provided for performing reversal development, a direct current, an alternating current, a dc voltage, or an ac voltage (including an electric current or an electric voltage in which alternating current is superimposed upon a direct current) having a polarity that is the same as the charging polarity of the toner that is supplied from each developing device 5 is supplied as the charging bias.

Each exposure device 23 is, for example, a non-scanning exposure device including a light-emitting diode, optical components, etc. Each exposure device 23 may be, for example, a scanning type including optical components such as a polygon mirror and a semiconductor laser. After image information that has been input from the outside of the image forming apparatus is subjected to a required processing operation by an image processor (not shown), the image information is input to each exposure device 23 as an image signal.

Each of the developing devices 5Y, 5M, 5C, and 5K is a two-component developing device that uses two-component developer 8 containing magnetic carriers and nonmagnetic toner containing a corresponding one of the color components Y, M, C, and K. The developing devices 5Y, 5M, 5C, and 5K are formed so that a required amount of supply developer is supplied thereto from removable-and-replaceable developer cartridges 14Y, 14M, 14C, and 14K via respective supply devices 15. Each of the developer cartridges 14Y, 14M, 14C, and 14K individually contains supply developer (only toner or toner and carriers). The developing devices 5 are described in detail below.

Each first transfer device 25 is a contact transfer device including a contact member, such as a first transfer roller, that rotates while contacting a surface of its corresponding photoconductor drum 21 and to which a first transfer bias is supplied. As the first transfer bias, a direct current or a dc voltage having a polarity that is opposite to the charging polarity of the toner is supplied.

Each drum cleaning device 26 includes a housing 26*a*, a plate member 26*b*, and a send-out member 26*c*, such as a screw auger. Each housing 26*a* has a cleaning opening. Each plate member 26*b* removes undesired substances, such as residual toner, by contacting, from the cleaning opening, at least the image holding surface of the corresponding photoconductor drum 21 that has passed a first transfer position. Each send-out member 26*c* recovers the removed substances, such as the removed residual toner, and sends out the removed substances towards a recovery container (not shown).

The intermediate transfer device 30 includes, for example, the intermediate transfer belt 31, multiple support rollers 32*a* to 32*g*, a second transfer roller 35, and a belt cleaning device 36. The intermediate transfer belt 31 rotates in the direction of arrow B while passing the first transfer positions situated between the photoconductor drums 21 and the first transfer devices 25 (first transfer rollers) of the respective image forming devices 20Y, 20M, 20C, and 20K. The support rollers 32*a* to 32*g* rotatably support the intermediate transfer belt 31 by holding the intermediate transfer belt 31 in a desired state from an inner peripheral surface of the intermediate transfer belt 31. The second transfer roller 35, serving as a second transfer device, rotates while contacting a portion of an outer peripheral surface of the intermediate transfer belt 31 that is supported by the support roller 32*f* by a predetermined pressure. The belt cleaning device 36 removes anything that is undesirable, such as toner and paper dust, which has remained on and adhered to the outer peripheral surface of the intermediate transfer belt 31 that has passed the second transfer roller 35.

The intermediate transfer belt 31 is, for example, an endless belt that is formed so as to have a required thickness and an electrical resistance value by using a material in which a resistance adjusting agent, such as carbon, is dispersed in a base material, such as polyimide resin or polyamide resin. Regarding the support rollers 32*a* to 32*g*, for example, the support roller 32*a* is a driving roller that applies rotational power to the intermediate transfer belt 31, the support rollers 32*b* and 32*c* are flattening rollers that form a first transfer surface of the intermediate transfer belt 31; the support roller 32*d* is a tension applying roller that applies tension to the intermediate transfer belt 31; the support roller 32*e* is a prior-to-second-transfer roller; and the support roller 32*f* is a second transfer backup roller.

The second transfer device includes the second transfer roller 35 and the support roller 32*f*, serving as a backup roller. A second transfer bias is supplied to the support roller 32*f* or the second transfer roller 35 of the second transfer device. When the second transfer bias is supplied to the second transfer roller 35, electric current or electric voltage having a polarity that is opposite to the charging polarity of the toner is supplied. When the second transfer bias is supplied to the support roller 32*f*, electric current or electric voltage having a polarity that is the same as the charging polarity of the toner is supplied.

The belt cleaning device 36 includes a housing 36*a*, a plate member 36*b*, a rotary brush 36*c*, and a send-out member 36*d*, such as a screw auger. The housing 36*a* has a cleaning opening. The plate member 36*b* and the rotary brush 36*c* remove undesired substances, such as residual toner, by contacting, from the cleaning opening, at least an image holding surface of the intermediate transfer belt 31 that has passed the second transfer position where the intermediate transfer belt 31 contacts the second transfer roller 35. The send-out member 36*d* recovers the removed substances, such as the removed residual toner, and sends out the removed substances towards a recovery container (not shown).

The sheet-feeding device 40 includes an accommodating member 41 and a send-out device 43. The accommodating member 41 is mounted on the housing 10 such that it is capable of being drawn out therefrom. The accommodating member 41 accommodates pieces of recording paper of, for example, desired sizes and types that are stacked on a stacking plate 42, the number of stacked pieces of recording paper 9 being a suitable number. The send-out device 43 sends out the pieces of recording paper 9 one at a time from the accommodating member 41 towards a sheet transport path. The number of accommodating members 41 is not limited to one. More than one accommodating members 41 may be used.

The fixing device 45 includes, for example, a heating rotary member 46 and a pressing rotary member 47 in an interior of a housing (not shown) of the fixing device 45. The heating rotary member 46 that is, for example, a roller or a belt, is rotationally driven in a required direction; and is heated by a heating unit to maintain its surface temperature at a required temperature. The pressing rotary member 47 that is, for example, a roller or a belt, is driven and rotated by contacting the heating rotary member 46 at a required pressure substantially along a direction of a rotation axis of the heating rotary member 46. In the fixing device 45, a region where the heating rotary member 46 and the pressing rotary member 47 contact each other is formed as a fixing processing portion where recording paper 9 that holds toner images is introduced and subjected to a fixing operation (pressing operation and a heating operation). As the heating rotary member 46 according to the first exemplary embodiment, a heating rotary member in the form of a belt including, for example, a fixing belt 48*c* and a heating pressing member 49 is used. The fixing belt 48*c* is rotatably supported by support rollers 48*a* and 48*b*. The heating pressing member 49 is disposed at an inner peripheral surface of the fixing belt 48*c*, presses an outer peripheral surface of the belt against the pressing rotary member 47, and heats the outer peripheral surface of the belt.

As shown in FIG. 1, the main sheet transport path is provided in the housing 10 for transporting recording paper 9 from the send-out device 43 of the sheet-feeding device 40 to the discharge opening 12 by passing the second transfer position at the intermediate transfer device 30 and the fixing processing portion at the fixing device 45 in this order. The sheet transport path is defined by, for example, transport roller pairs 44*a* to 44*f*, a transport belt device 44*h*, and a transport guide member. In particular, the transport roller pair 44*d* is a registration roller pair having a function, such as adjusting a transport orientation and a transport timing of recording paper 9 to the second transfer position. The transport roller pair 44*f* includes discharge rollers that discharge recording paper 9 from the discharge opening 12.

In the image forming apparatus 1, by selecting and operating all of the image forming devices 20Y, 20M, 20C, and 20K or some of the image forming devices 20Y, 20M, 20C, and 20K (for at least two different toner colors), it is possible to form a multi-color image formed from a combination of toners of all four colors Y, M, C, and K or toners of some of the colors. In addition, by operating one of the image forming devices 20Y, 20M, 20C, and 20K, it is possible to form, for example, a monochrome image formed from toner of one color, such as black.

A basic image formation operation is actually performed by the image forming apparatus 1 as follows. Here, a case in which a multi-color image, which is a combination of toner images of four colors Y, M, C, and K, is formed, that is, a case in which a full-color image is formed, is described as an example.

First, when each of the four image forming devices 20Y, 20M, 20C, and 20K receives a request for forming (printing) an image, the four image forming devices 20Y, 20M, 20C, and 20K form toner images in substantially the same way.

That is, in each of the image forming devices 20Y, 20M, 20C, and 20K, the corresponding photoconductor drum 21 rotates in the direction of arrow A, and the corresponding charging device 22 charges to a required polarity (for example, a minus polarity in the first exemplary embodiment) and a required potential the image holding surface of the corresponding photoconductor drum 21 by electric discharge that is generated on the basis of a charging bias that is supplied to the corresponding charging roller. After the charging, on the basis of an image signal that is transmitted as a result of separating the four color components Y, M, C, and K, each exposure device 23 performs exposure (light irradiation) on the charged image holding surface of the corresponding photoconductor drum 21. This causes electrostatic latent images containing the respective color components formed by a predetermined potential difference to be individually formed on the image holding surfaces of the respective photoconductor drums 21.

Next, in the image forming devices 20Y, 20M, 20C, and 20K, the electrostatic latent images containing the respective color components formed on the image holding surfaces of the respective photoconductor drums 21 are developed by supplying toners of the respective colors Y, M, C, and K in the two-component developers 8 thereto. The electrostatic latent images containing the respective colors components on the photoconductor drums 21 are rendered visible as toner images of the four colors Y, M, C, and K corresponding to the respective color components.

Next, the toner images of the respective colors formed on the photoconductor drums 21 of the respective image forming devices 20Y, 20M, 20C, and 20K are transferred to recording paper 9 via the intermediate transfer device 30.

That is, the toner images of the respective colors formed on the photoconductor drums 21 are each transported to the corresponding first transfer position where the photoconductor drum 21 and the corresponding first transfer device 25 contact each other with the rotating intermediate transfer belt 31 being interposed therebetween. Then, at each first transfer position, a first transfer electric field that is generated between the photoconductor drum 21 and the first transfer device 25 (with the intermediate transfer belt 31 being interposed therebetween) on the basis of the first transfer bias that is supplied to the transfer roller of the first transfer device 25 causes the toner images to be electrostatically first-transferred to the intermediate transfer belt 31.

Then, after the toner images that have been first-transferred to the intermediate transfer belt 31 have been transported to the second transfer position by the rotation of the intermediate transfer belt 31, at the second transfer position, a second transfer electric field that is generated on the basis of the second transfer bias that is supplied to the second transfer roller 35 causes the toner images to be electrostatically and collectively second-transferred to recording paper 9 that is sent out from the sheet-feeding device 40 and that is transported at a required timing via the sheet transport path.

Lastly, the toner images transferred to the recording paper 9 are fixed by the fixing device 45.

That is, the recording paper 9 to which the toner images have been second-transferred by the intermediate transfer device 30 is separated from the intermediate transfer belt 31 and is, then, transported to the fixing device 45. In the fixing device 45, the recording paper 9 to which the toner images have been transferred is introduced into the fixing processing portion that is situated between the heating rotary member 46 and the pressing rotary member 47 in the form of belts, and is heated and pressed. This causes the toner of the toner images to be melted and to be fixed to the recording paper 9. When images are to be formed on only one surface of the recording paper 9, the recording paper 9 where the fixing operation has been completed is discharged to the outside of the housing 10 after being transported up to the discharge opening 12 via the sheet transport path.

By the above-described image forming operations, a full-color image that is a combination of the toner images of the four colors is formed on one surface of one piece of recording paper 9.

Structure of Developing Devices

Next, the developing devices 5Y, 5M, 5C, and 5K are described in detail.

Referring to, for example, FIGS. 2 to 5, each of the developing devices 5Y, 5M, 5C, and 5K includes, for example, a housing 50, a developing roller 53, a regulating plate 54, two screw augers 55 and 56, and a ventilation path portion 7. Each housing 50 contains the two-component developer 8. Each developing roller 53 is disposed in the corresponding housing 50. Each regulating plate 54 serves as an exemplary regulating member. The two screw augers 55 and 56 serve as exemplary transporting members. Part of air in each housing 50 passes through the corresponding ventilation path portion 7 so as to flow out therefrom.

Figure 6:
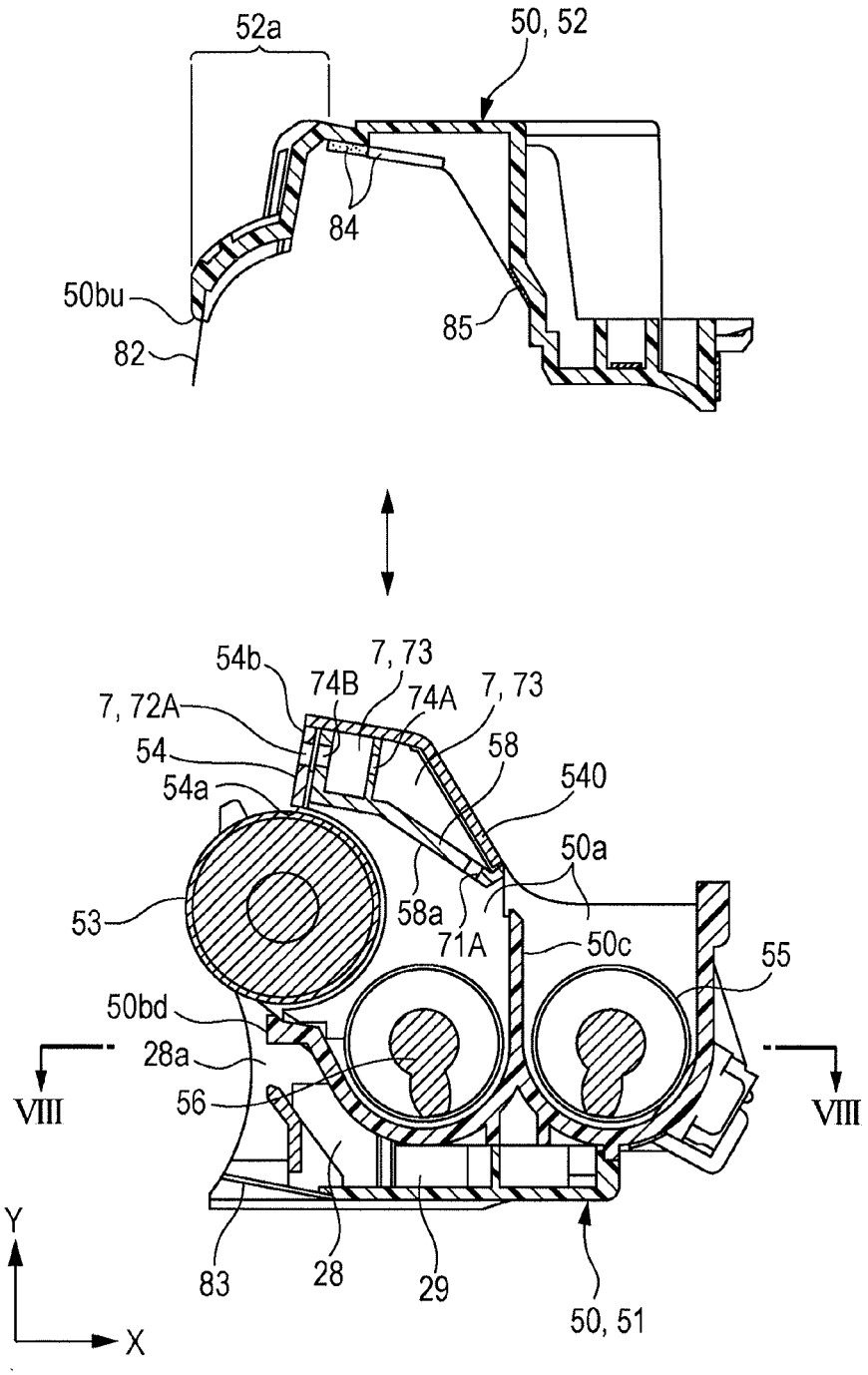
FIG. 6 is a schematic sectional view illustrating a state in which the developing device shown in FIG. 5 is separated into the upper housing and the lower housing.

Referring to, for example, FIGS. 4 to 6, each housing 50 is a structural member whose entire exterior is long in one direction. Each housing 50 includes, for example, an accommodating chamber 50*a*, a development opening 50*b*, a supply portion 50*c*, and a discharge portion 50*d* (for a trickle development system). Each accommodating chamber 50*a* accommodates the two-component developer 8. Each development opening 50*b* is formed in a portion of the accommodating chamber 50*a* that faces the corresponding photoconductor drum 21 serving as a latent image holding member. Each supply portion 50*c* receives developer that is supplied to the corresponding accommodating chamber 50*a*. Each discharge portion 50*d* discharges the two-component developer 8 by causing part of the two-component developer 8 in the accommodating chamber 50*a* to overflow therefrom.

Referring to, for example, FIGS. 4 and 6, each housing 50 according to the first exemplary embodiment has a structure in which it is divided into a lower housing 51 and an upper housing 52. Each lower housing 51 has a structure where substantially the entire accommodating chamber 50*a* and a lower portion of the development opening 50*b* are formed. Each upper housing 52 has a structure where an upper portion of the development opening 50*b* and a portion that covers the lower housing 51 from thereabove excluding the supply portion 50*c* at the accommodating chamber 50*a* are formed. Each housing 50 is formed by, for example, a required forming method using synthetic resin.

Portions of the accommodating chamber 50*a* of each housing 50 are connected to each other at both end portions in a longitudinal direction and are separated by a partition 50*e* at a central portion. Accordingly, each accommodating chamber 50*a* includes two circulation transport paths 50*f* and 50*g* (that is, a first circulation transport path 50*f* and a second circulation transport path 50*g*) that are parallel to each other as a whole. Each development opening 50*b* has a rectangular shape that is slightly wider than an effective image formation region of the corresponding photoconductor drum 21 in a rotation axis direction thereof. Each supply portion 50*c* is formed as a member that makes use of one end portion of the corresponding accommodating chamber 50*a*, and has a receiving opening 50*h* that is provided at an upper surface portion thereof and that is provided for receiving supply developer. Each discharge portion 50*d* is formed as a portion formed by causing a portion where the screw auger 55 is disposed to protrude and extend from the other end portion of the accommodating chamber 50*a*, and has a discharge opening 50*i* that is provided at a lower surface (bottom surface) thereof and that causes overflowing developer 8 to drop and to be discharged.

Referring to, for example, FIG. 5, each developing roller 53 includes a sleeve 53A and a magnet roller 53B in the interior of the housing 50. Each sleeve 53A, serves as a cylindrical transporting member, which rotates while a portion thereof is exposed from the development opening 50*b*. Each magnet roller 53B, serves as a magnet member, which exists while being secured in a cylindrical space of the sleeve 53A. Each developing roller 53 is disposed and used while being out of contact with and being separated by a required gap from an outer peripheral surface portion, which becomes a development region, of the photoconductor drum 21.

Using nonmagnetic material, such as stainless steel or aluminum, each sleeve 53A is formed with a cylindrical shape including an effective development region having a width (length) that is substantially the same as that of the effective image formation region of the photoconductor drum 21 in the rotation axis direction. Each sleeve 53A has rotating holding portions (non-development regions) 53Ab and 53Ac at respective end portions of the effective development region, with inner sides of the rotating holding portions being rotatably mounted on, for example, shaft portions of the magnet roller 53B. In addition, each sleeve 53A has a shaft portion 53Ad that protrudes and extends outward from the rotating holding portion 53Ac in a rotation axis direction, with a portion of the shaft portion 53Ad being rotatably supported by the housing 50. Each sleeve 53A faces the corresponding photoconductor drum 21 with the rotation axis direction of each sleeve 53A and the rotation axis direction of the corresponding photoconductor drum 21 being parallel to each other.

Rotation power is transmitted from a rotation driving device (not shown) at a side of a body of the image forming apparatus 1 to each sleeve 53A via a removable connecting tool (sprocket or the like) that is mounted on the corresponding shaft portion 53Ad, so that each sleeve 53A is rotationally driven in the direction of arrow C. A development bias for generating a development electric field between each photoconductor drum 21 and the corresponding sleeve 53A is supplied to the corresponding sleeve 53A from a feeding device (not shown). As the development bias, for example, dc voltage upon which an alternating current component is superimposed is supplied.

Each magnet roller 53B has a structure in which multiple magnetic poles (S poles and N poles) are disposed for generating magnetic force that causes magnetic carriers of the two-component developer 8 to adhere to an outer peripheral surface of the corresponding sleeve 53A such that magnetic brushes are formed along magnetic lines of force. Each magnet roller 53B is mounted with, for example, the shaft portions that are formed so as to protrude from the respective end portions thereof being secured to side wall portions of the corresponding housing 50. The multiple magnetic poles extend in the rotation axis direction of the sleeve 53A, and are disposed apart from each other by required intervals in the rotation direction C of the sleeve 53A.

Figure 7:
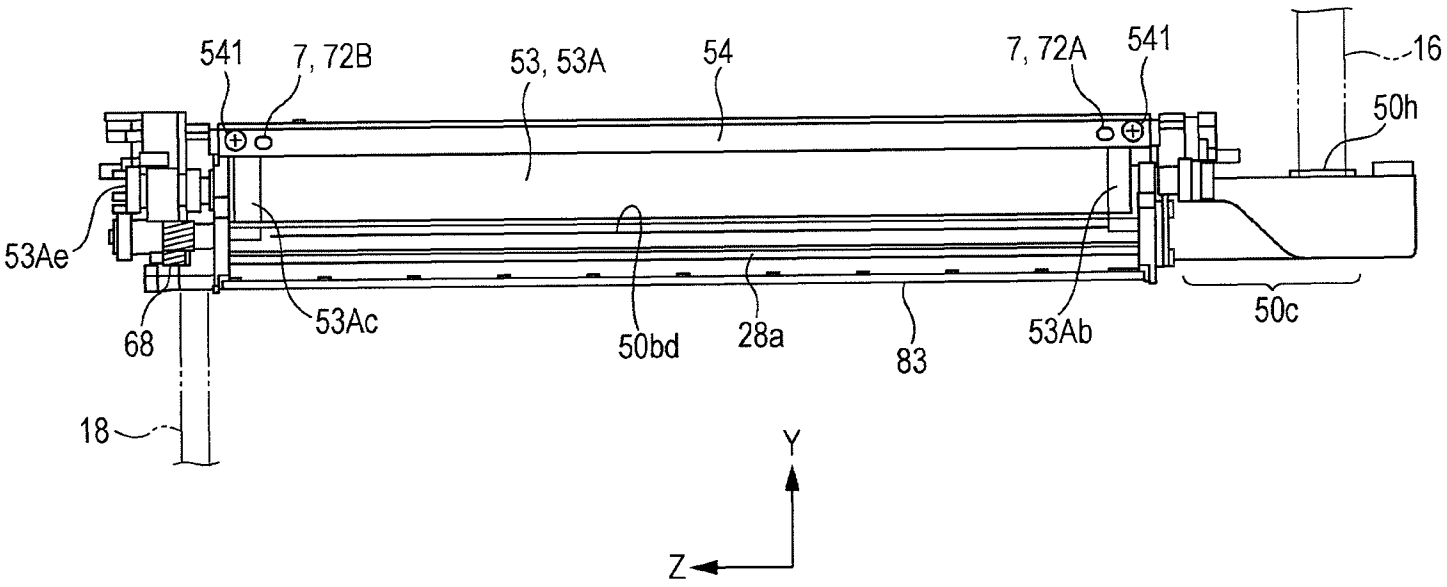
FIG. 7 is an explanatory view illustrating a state of the developing device shown in FIG. 3 when seen from a side of a developing roller.

Referring to, for example, FIGS. 5 to 7, each regulating plate 54 is a rectangular plate having a certain thickness and having a length (long sides) that is greater than or equal to the length (effective development region) of the developing roller 53 ((sleeve 53A) in the rotation axis direction. Each regulating plate 54 is mounted while being secured to both end portions of the housing 50 (lower housing 51) in the longitudinal direction with, for example, fixing screws such that both end portions (lower long side portion) of the regulating plate 54 are separated from the surface of the sleeve 53A of the developing roller by a required gap (regulation interval) and face the surface of the sleeve 53A of the developing roller in an axial direction. Each regulating plate 54 is formed of, for example, a nonmagnetic material, such as stainless steel.

Each regulating plate 54 according to the first exemplary embodiment is integrated with a supporting plate 540 having a shape that allows it to extend upstream in the rotation direction C of the developing roller 53 (sleeve 53A) from an upper side portion 54*b* of the regulating plate 54 and cover the second circulation transport path 50*g* from thereabove and that allows it to extend to a location near an upper end portion of the partition 50*e*. Each supporting plate 540 is formed of, for example, a nonmagnetic or a magnetic metallic material. In the first exemplary embodiment, each supporting plate 540 is formed of the same material as the regulating plate 54 and integrated with the regulating plate 54.

Each screw auger 55 has a structure in which a plate transport blade 55*b* is spirally wound around a peripheral surface of a rotary shaft 55*a*. Each screw auger 56 has a structure in which a plate transport blade 56*b* is spirally wound around a peripheral surface of a rotary shaft 56*a*. The screw augers 55 and 56 (may hereunder be referred to as a first screw auger 55 and a second screw auger 56) are disposed so as to exist in the two circulation transport paths, that is, the circulation transport path 50*f* and the circulation transport path 50*g* in the accommodating chamber 50*a* of each housing 50. The screw augers 55 and 56 are mounted in a state in which they rotate in a required direction so as to transport the developers 8 in the respective transport paths 50*f* and 50*g* in certain directions (opposite directions). The screw augers 55 and 56 are disposed side by side parallel to the corresponding developing roller 53. Each second screw auger 56 that is disposed closer to the developing roller 53 has the role of supplying part of the two-component developer 8 that it transports to the developing roller 53.

Figure 8:
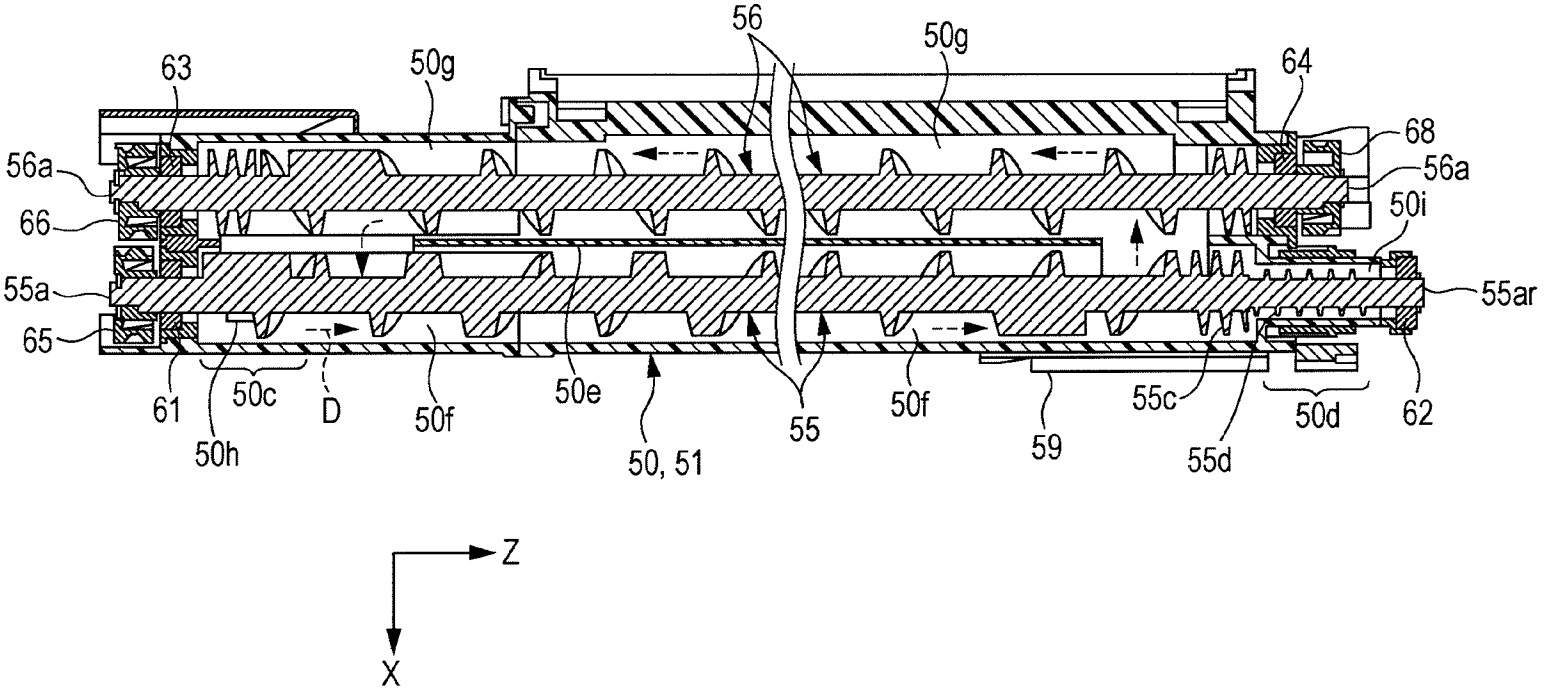
FIG. 8 is a schematic sectional view taken along line VIII-VIII of a portion of the developing device shown in a lower part of FIG. 6 (that is, a portion including the lower housing)

Referring to FIG. 8, the rotary shaft 55*a* of each screw auger 55 is rotatably supported by multiple bearings 61 and 62 provided at the side wall portions that correspond to two ends of the housing 50 (lower housing 51) in the longitudinal direction; and the rotary shaft 56*a* of each screw auger 56 is rotatably supported by multiple bearings 63 and 64 provided at the side wall portions that correspond to the two ends of the housing 50 (lower housing 51) in the longitudinal direction.

Further, a transmission gear 65 that is secured to one end portion of each rotary shaft 55*a* and a transmission gear 66 that is secured to one end portion of each rotary shaft 56*a* are connected to each other via a relay gear 67 that engages with both of the transmission gears 65 and 66 at the same time, so that the screw augers 65 and 66 are rotatable in the same direction (for example, a counterclockwise direction in FIG. 5). Each second screw auger 56 is such that a gear 68 that is secured to an end portion (far side) of the rotary shaft 56*a* engages with a transmission gear (not shown) via the relay gear 67, the transmission gear that is not shown being secured to a far-side end portion of the shaft portion of the developing roller 53 (sleeve 53A) (see FIG. 3).

By this, rotary power that is distributed from each developing roller 53 is transmitted to the corresponding first screw auger 55 via the corresponding second screw auger 56, so that the screw augers 55 and 56 are rotationally driven in a required direction in the transport path 50*f* and the transport path 50*g*, respectively.

Referring to FIG. 5 and FIG. 6, each of the developing devices 5Y, 5M, 5C, and 5K is provided with a rectifying member 58 which adjusts the flow of, of the second-component developer 8 that has been supplied to and held by the developing roller 53, a part thereof held back by the regulating plate 54 and returned to at least a side of the second circulation transport path 50*g* where the second screw auger 56 exists.

Each rectifying member 58 is disposed so as to extend from the regulating plate 54 to a location above the second screw auger 56 (or the second circulation transport path 50*g*) so as to be separated from the developing roller 53 in the accommodating chamber 50*a* of the housing 50.

Each rectifying member 58 according to the first exemplary embodiment is a structural member including at least a flat rectifying surface 58*a* that is placed in a space that is surrounded by the regulating plate 54 and a lower surface of the supporting plate 540, extends in a direction away from a location that is situated slightly above a lower end portion 54*a* of the regulating plate 54, and gradually extends away from the outer peripheral surface of the developing roller 53 (sleeve 53A). Of portions of each rectifying surface 58*a*, an end portion thereof that is situated opposite to the regulating plate 54 is formed at a position that substantially corresponds with that of an end portion of the supporting plate 540 at the regulating plate 54. Each rectifying member 58 has, for example, a reinforcing portion or fixing portion that contacts an inner surface of the regulating plate 54 or the lower surface of the supporting plate 540. Each rectifying member 58 is mounted with fixing screws 580 (FIG. 4) while in contact with the inner surface of the regulating plate 54 and the lower surface of the supporting plate 540.

By setting each rectifying member 58, the two-component developer 8 (principally toner) that is held back by the regulating plate 54 flows so as to return to the second circulation transport path 50*g* while being guided along the rectifying surface 58*a* without being stopped in the vicinity of the regulating plate 54.

Referring to, for example, FIGS. 3, 4, 7, and 8, the supply portion 50*c* of each of the developing devices 5Y, 5M, 5C, and 5K is formed as a portion formed by causing an end portion of the accommodating chamber 50*a* of the housing 50 to protrude and extend towards the near side from an end portion of the developing roller 53. Referring to, for example, FIGS. 7 and 8, the circulation transport paths 50*f* and 50*g* also extend and are formed in the support portion 50*c* at each accommodating chamber 50*a*. The screw augers 55 and 56 extend and exist in the respective circulation transport paths 50*f* and 50*g*.

The receiving opening 50*h* at each support portion 50*c* is formed above a portion where the supply portion 50*c* at the corresponding first screw auger 55 exists. Referring to, for example, FIGS. 2 and 7, developer supply pipes 16 for being connected to the respective supply devices 15 that send out supply two-component developers that are accommodated in the respective developer cartridges 14Y, 14M, 14C, and 14K are mounted at the respective receiving openings 50*h*.

Figure 9:
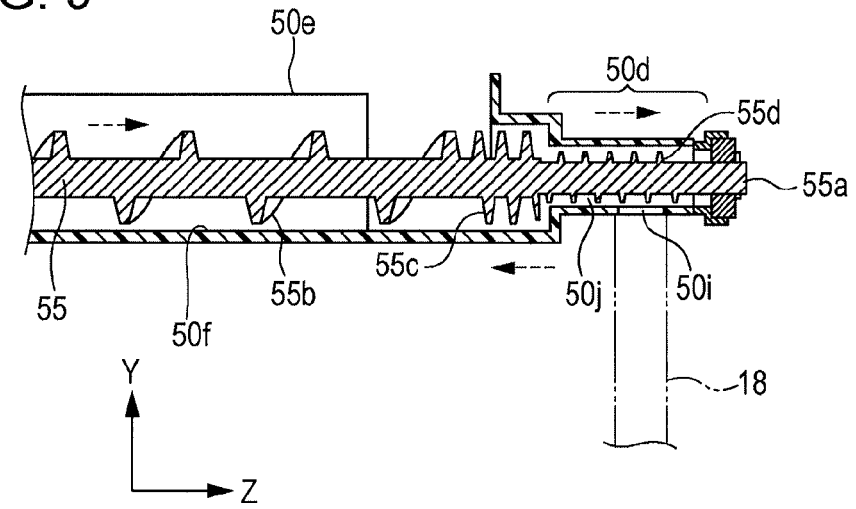
FIG. 9 is an enlarged vertical sectional view of a discharge portion at the portion of the developing device shown in FIG. 8.

Referring to, for example, FIGS. 8 and 9, the discharge portion 50*d* of each of the developing devices 5Y, 5M, 5C, and 5K is formed as a portion that is formed by causing an end portion of a portion of the accommodating chamber 50*a* of the housing 50 where the circulation transport path 50*f* is formed to extend and protrude towards a far side from an end portion of the developing roller 53. Referring to FIG. 8, each discharge path 50*j* provided with a bottom surface portion that is disposed at an upper side from a bottom portion of the circulation transport path 50*f* by a required length is formed in the discharge portion 50*d* at each accommodating chamber 50*a*. Each first screw auger 55 extends and exists in the corresponding discharge path 50*j*. Each first screw auger 55 includes a return transport blade portion 55*c* that is provided at the corresponding rotary shaft 55*a* at a portion of the circulation transport path 50*f* that is where an end portion of the partition 50*e* does not exist and that is situated at a near side of the discharge path 50*j*. Each return transport blade portion 55*c* is provided for transporting the developer 8 such that the developer 8 returns to the circulation transport path 50*f*. Each first screw auger 55 includes a discharge blade portion 55*d* that is provided at the rotary shaft 55*a* where the discharge path 50*j* exists. Each discharge blade portion 55*d* is provided for transporting the developer 8 that has flowed into the discharge path 50*j*, which is situated one step higher than the circulation transport path 50*f*, from the circulation transport path 50*f* towards the discharge opening 50*i*.

The discharge opening 50*i* at each supply portion 50*c* is formed at a location (bottom surface portion) that is situated below a portion of the discharge path 50*j* where at least the first screw auger 55 exists. Referring to, for example, FIGS. 2, 7, and 9, a developer discharge pipe 18 is mounted at each discharge opening 50*i*. Each developer discharge pipe 18 is provided for being connected to a recovery container 17 that accommodates and recovers the developer 8 that is discharged from the discharge opening 50*i*.

Referring to, for example, FIGS. 4 to 7, the ventilation path portion 7 of each of the developing devices 5Y, 5M, 5C, and 5K is provided so as to extend through the corresponding regulating plate 54 after extending to the corresponding regulating plate 54 from a portion of the accommodating chamber 50*a* of the housing 50, and is connected to gap spaces S (S1 and S2) that exist between the developing roller 53 and the housing 50 (upper housing 52) in a range extending to the development opening 50*b* from where the developing roller 53 passes the regulating plate 54.

Here, a portion of each accommodating chamber 50*a* is a portion where an entrance (71) of the ventilation path portion 7 is provided. From the viewpoint of, for example, preventing easy entry of developer 8 (in particular, toner), it is desirable that a portion of each accommodating chamber 50*a* be a portion that is situated as far as possible from the developing roller 53, such as a location that is above the screw augers 55 and 56. Referring to, for example, FIG. 5, the gap spaces S include the first gap space S1 and the second gap space S2. Each first gap space S1 exists between the developing roller 53 and a front-end side portion 52*a* (see FIG. 6) of the housing 50 (upper housing 52) in a range extending from the regulating plate 54 to an upper side portion 50*bu* of the development opening 50*b*. Each second gap space S2 exists between the regulating plate 54 and the front-end side portion 52*a* of the corresponding housing 50. It is necessary for each first gap space S1 and its corresponding second gap space S2 to be connected to each other.

Each ventilation path portion 7 according to the first exemplary embodiment includes entrances 71 (71A and 71B) that are provided at end portions of the rectifying member 58 that are opposite to the regulating plate 54, exits 72 (72A and 72B) that are provided at portions of the regulating plate 74 that face the end portions (rotating holding portions; non-development regions) of the developing roller 53 in the rotation axis direction, and a path section 73 that allows the entrances 71 and the exits 72 to be connected to each other so as to allow ventilation.

Referring to FIGS. 4 and 7, in particular, each ventilation path portion 7 includes, as the exits 72, the individual exits 72A and 72B that exist at portions of the regulating plate 74 facing the end portions 53Ab and 53Ac of the developing roller 53. Therefore, as the entrances 71, the individual entrances 71A and 71B that exist at portions of the rectifying member 58 substantially facing the end portions 53Ab and 53Ac of the developing roller 53 are provided. Although the entrances 71 and the exits 72 are formed as round openings or square openings, the entrances 71 and the exits 72 are not particularly limited thereto. The entrances 71 and the exits 72 only need to be openings (through holes) having sizes that at least allow air to pass therethrough. The diameter of each opening or the length of one side of each opening is, for example, in the range of from 2 mm to 6 mm.

For the path section 73 in each ventilation path portion 7, a space that exists between the rectifying member 58 and the supporting plate 540 at the regulating plate 54 is used. When portions of each rectifying member 58 (reinforcing portion, fixing portion, etc.) that block portions between the entrances 71 and the exits 72 are provided at the path section 73, through holes 74A and 74B are provided in the portions that block the portions between the entrances 71 and the exits 72, so that the entrances 71 and the exits 72 are caused to be connected to each other by a continuously formed path space. Each path section 73 may be formed so as to include a first path section 73A that causes the entrance 71A and the exit 72A that are positioned at one of the two end portions to be connected to each other by a dedicated path space and a second path section 73B that causes the entrance 71B and the exit 72B that are positioned at the other of the two end portions to be connected to each other by a dedicated path space (two path sections that are indicated by dotted lines 73 in FIG. 4); or may be formed as one common path section that causes the entrances 71A and 71B and the exits 72A and 72B to be connected to each other by a common path space. Incidentally, since each rectifying member 58 according to the first exemplary embodiment is a hollow structure including a reinforcing partition wall, it is possible to use an internal space of the hollow structure as the path section 73.

Each ventilation path portion 7 is provided such that its exits 72 are directly connected to the second gap space S2 that exists between the regulating plate 54 and the front-end side portion 52*a* of the housing 50 (upper housing 52). Each second gap space S2 is connected to the corresponding gap space S1 at a location situated below a lower end portion of the second gap space S2.

Each of the developing devices 5Y, 5M, 5C, and 5K is provided with an intake path 28, where an intake opening 28*a* is disposed, at a portion of the housing 50 that is situated downstream in the rotation direction C of the developing roller 53 from a portion where the developing roller 53 faces the photoconductor drum 21 (development region). Each intake path 28 is connected to an intake duct 102 via a terminal end portion 29 at the intake path 28. Each intake duct 102 extends from an intake device 101 that is disposed in the housing 10 of the image forming apparatus 1. By causing the influence of an intake action of each intake device 101 to reach the intake opening 28*a*, each intake device 101 recovers, in particular, toner that floats in a space between the developing device 5 and the corresponding photoconductor drum 21 by sucking in such toner from the intake opening 28*a*.

A structural portion of each intake path 28 may be provided by attaching it later to a bottom surface portion of the lower housing 51 of the developing device 5. In addition, the structural portion of each intake path 28 may also be initially integrated with a portion of the lower housing 51. Referring to FIG. 7, each intake opening 28*a* is formed so as to, as a long-and-narrow rectangular opening that is parallel to the rotation axis direction of the developing roller 53, exist at a location that is close to a lower side portion 50*bd* of the development opening 50*b* of the lower housing 51. Each intake device 101 is formed from at least an intake fan. Each intake device 101 is provided with a filter at, for example, a position that is situated downstream from the intake duct 102 (immediately in front of the intake fan), or at a position between the intake fan and an exhaust opening (not shown) that is provided in the housing 10 of the image forming apparatus. Each filter is provided for trapping, for example, toner that has been sucked and recovered.

A toner density detecting sensor 59 that detects the amount of two-component developer 8 (actually the density of toner) accommodated in the first circulation transport path 50*f* of the accommodating chamber 50*a* is provided at each of the developing devices 5Y, 5M, 5C, and 5K (see, for example, FIGS. 3 and 5).

A film-like leakage preventing member 82 that is held while its free end is in contact with the outer peripheral surface of the photoconductor drum 21 and that prevents leakage of developer 8 to the outside of the housing 50 is provided at an inner side of the upper side portion of the development opening 50*b* of each housing 50 (upper housing 52) (see, for example, FIG. 5). A sheet-like developer trapping member 83 that is held while its free end is close to the outer peripheral surface of the photoconductor drum 21 and that prevents dropping and leakage of developer 8 to the outside of the housing 50 is provided at a portion of each housing 50 (lower housing 51) that is situated below the lower side portion of the development opening 50*b* (and the intake opening 28*a*) (see, for example, FIG. 5).

Leakage preventing members 84 and 85 that are formed of, for example, elastic foaming materials, and that prevent leakage of developer 8 are provided at portions of an upper surface of the supporting plate 540 at each regulating plate 54 that contacts an inner surface of the corresponding upper housing 52 (see, for example, FIGS. 5 and 6).

Operations of Developing Devices

Operations of the developing devices 5Y, 5M, 5C, and 5K are hereunder described.

First, when images are to be formed by the image forming apparatus 1, each of the developing devices 5Y, 5M, 5C, and 5*k* is such that the sleeve 53A of the developing roller 53 and the screw augers 55 and 56 start rotating, and development bias is applied to the sleeve 53A of each developing roller 53.

By this, the two-component developer 8 that is accommodated in the accommodating chamber 50*a* of each housing 50 is transported in the circulation paths 50*f* and 50*g* in the accommodating chamber 50*a* in each of the directions of dotted arrows in FIG. 8 while being stirred by the rotating screw augers 55 and 56, so that the two-component developer 8 is in a state in which it circulates when viewed as a whole (that is, the two-component developer 8 circulates in a counterclockwise direction in FIG. 8). Here, the two-component developer 8 in each accommodating chamber 50*a* is such that the nonmagnetic toner thereof is sufficiently stirred with the magnetic carriers, is frictionally charged, and is electrostatically adhered to surfaces of the carriers.

Next, part of each two-component developer 8 that is transported by the second screw auger 56 disposed closer to the corresponding developing roller 53 is held by being attracted to the outer peripheral surface of the sleeve 53A of the corresponding developing roller 53 by magnetic force. That is, by causing the influence of the magnetic force that is generated from a required magnetic pole (pickup pole) of each magnet roller 52B to reach the outer peripheral surface of the corresponding rotating sleeve 53A, the magnetic carriers to which the toner has adhered are held while magnetic brushes in which many chains are connected and stand are formed.

Figure 10:
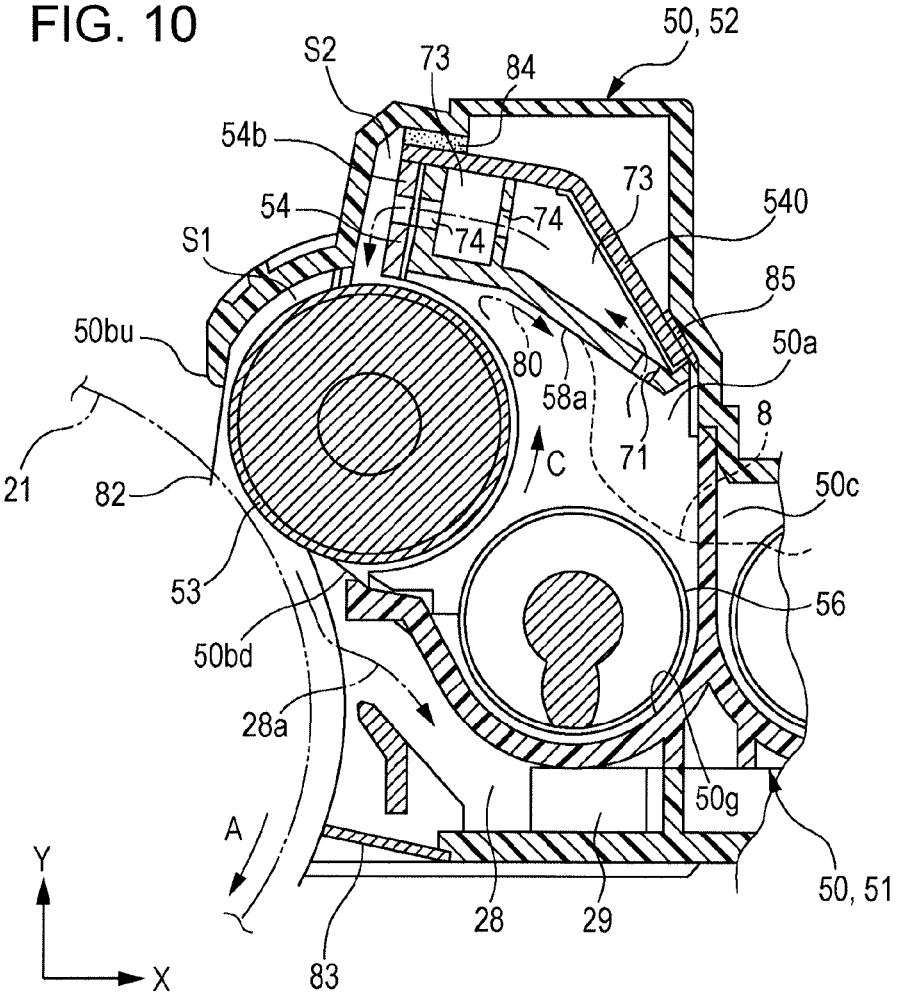
FIG. 10 is an enlarged explanatory view of a principal portion for illustrating an operation of the developing device shown in FIG. 3.

Next, when the two-component developer 8 held by the sleeve 53A of each developing roller passes through a required gap (regulation gap), formed between the sleeve 53A and the regulating plate 54, while being transported as the sleeve 53A rotates, the two-component developer 8 is formed to a substantially certain film thickness (magnetic brush height) as a result of regulating its passage. Referring to FIG. 10, two-component developer 80 held back as a result of regulating its passage by its corresponding regulating plate 54 is such that the direction and state of the movement of the two-component developer 80 are regulated by the rectifying surface 58*a* of its corresponding rectifying member 58, so that the two-component developer 80 moves along its corresponding rectifying surface 58*a*, finally drops freely, and returns to the interior of the second circulation transport path 50*g*.

Next, each two-component developer 8 that has passed its corresponding regulating plate 54 is held by the outer peripheral surface of the sleeve 53A of the corresponding developing roller 53 while being subjected to magnetic force that is generated from a required magnetic pole (transport pole) of the corresponding magnetic roller 53B. After each two-component developer 8 has passed the corresponding development opening 50*b* as a result of the rotation of the corresponding sleeve 53A in the direction of arrow C, each two-component developer 8 is transported up to the development region opposing the photoconductor drum 21.

Each two-component developer 8 that has been transported to the development region is such that front end portions of the magnetic brushes are caused to move while in contact with the outer peripheral surface of the corresponding photoconductor drum 21. During this movement, a development (alternating) electric field that is generated between each developing roller 53 and its corresponding photoconductor drum 21 by the development bias that is applied to the corresponding sleeve 53A causes only the toner thereof to electrostatically adhere to an electrostatic latent image on the corresponding photoconductor drum 21 while it reciprocates between the developing roller 53 and the corresponding photoconductor drum 21. This causes the electrostatic latent images to be developed by the respective developing devices 5.

The two-component developer 8 on each developing roller 53 that has passed the development region without contributing to the development step passes the development opening 50*b* while being held by the outer peripheral surface of the corresponding sleeve 53A by the magnetic force, and is transported to the interior of the corresponding housing 50. Thereafter, in principle, each two-component developer 8 is subjected to a repelling magnetic force that is generated by a required magnetic pole (pickoff pole) of the corresponding magnetic roller 53B, so that each two-component developer 8 is peeled off from the corresponding sleeve 53A and is returned to the interior of the corresponding accommodating chamber 50*a* (second circulation transport path 50*g*). Each developer 8 that has been peeled off and returned to the accommodating chamber 50*a* is transported while being stirred again by the second screw auger 56 in the corresponding second circulation transport path 50*g*, and is returned and transported to the corresponding second circulation transport path 50*a* via the corresponding first circulation transport path 50*f*.

In the developing devices 5Y, 5M, 5C, and 5K, the two-component developers 8 are consumed and reduced in amount by the development step. Therefore, for example, on the basis of detection results provided by the toner density detecting sensors 59, the supply devices 15 send out required amounts of supply developer 8 from the respective developer cartridges 14Y, 14M, 14C, and 14K, so that the developer devices 5Y, 5M, 5C, and 5K are replenished with the developer.

The developers 8 that have been supplied from the supplying devices 15 via the respective developer supply pipes 16 are received by the first circulation transport paths 50*f* from the receiving openings 50*h* of the respective supply portions 50*c*. Thereafter, the supplied developers 8 are transported in the directions of the dotted arrows D by the respective first screw auger 55 in the respective first circulation transport paths 50*f*, and, while being transported, are mixed with the two-component developers 8 that are already accommodated in the respective accommodating chambers 50*a*.

Further, the developing devices 5Y, 5M, 5C, and 5K use what is called a trickle development system that is a system in which part of the toner that has deteriorated as a result of circulating and moving in each accommodating chamber 50*a* (and as a result of being held and transported by each developing roller 53 without being used for the developing operation). Therefore, of portions of the two-component developers 8 that are transported in the first circulation transport paths 50*f* by the respective first screw augers 55, portions of the developers 8 that have become excessive due to, for example, the supplying of developer flow up into the respective discharge paths 50*j*, which is one step higher, at the respective discharge portions 50*d*.

The portions of the developers 8 that have flown into the discharge paths 50*j* at the respective discharge portions 50*d* are transported by the discharge blade portions 55*d* of the respective first screw augers 55, finally drop freely from the respective discharge openings 50*i*, and are discharged to the outside. That is, the portions of the two-component developers 8 flow out and are discharged at the respective discharge portions 50*d*. The portions of the developers 8 that have been discharged from the respective discharge portions 50*d* pass through the developer discharge pipes 18, are accommodated in the recovery containers 17, and are recovered.

In each of such developing devices 5Y, 5M, 5C, and 5K, as the speed of an image forming operation increases, even in a developing operation, the developing roller 53 (sleeve 53A) is rotationally driven at a relatively high speed (for example, 590 rpm or higher). Therefore, the pressure (internal pressure) in the interior (accommodating chamber 50*a*) of each housing 50 is increased. In this case, the increase in the internal pressure causes an air pressure difference to occur between the accommodating chamber 50*a* of each housing 50 and the outside. Consequently, (actually, the jumping up of the developers 8 due to stirring of the developers 8 by the screw augers 55 and 56 that rotate at a high speed also being a cause), the developers 8 (principally the toner) in the accommodating chambers 50*a* are scattered and enter the discharge paths 50*j* at the respective discharge portions 50*d*, as a result of which, thereafter, they may be discharged from the discharge openings 50*i* of the respective discharge portions 50*d*.

The amount of developer that is discharge in this way becomes an unexpected amount that exceeds an actually intended amount of developer that is discharged from the discharge opening 50*i* of each discharge portion 50*d* by the trickle development system. As a result, for example, the amount of developer 8 that is accommodated in each accommodating chamber 50*a* may be less than a prescribed amount.

Each of the developing devices 5Y, 5M, 5C, and 5K is provided with the aforementioned ventilation path portion 7. Therefore, even in cases where the internal pressure tends to be increased as a result of, for example, each developing roller 53 being rotationally driven at a high speed, part of the air that exists in the accommodating chamber 50*a* of each housing 50 flows into the gap spaces S (S1 and S2) via the ventilation path portion 7, and is, then, discharged to the outside of the corresponding housing 50, as exemplified by an alternate long and short dashed arrow in FIG. 10.

More specifically, part of the air that exists in each accommodating chamber 50*a* enters from the entrances 71 (71A and 71B) of the ventilation path portion 7 provided at a portion of each accommodating portion 50*a*, and, then, flows into the second gap space S2 from the exits 72 (72A and 72B) via the path spaces (including the through holes 74A and 74B) of the path sections 73 (73A and 73B) of the ventilation path portion 7. Then, the air that has flow out flows into each first gap space S1 from the corresponding second gap space S2, and, then, passes through the development opening 50*b* of the corresponding housing 50 to the outside of the corresponding housing 50 from, for example, a gap between the developing device 5 and the photoconductor drum 21. During this time, air currents that flow in the same direction as the direction of arrow C of each developing roller 53 (sleeve 53A) is generated in each first gap space S1. The developer 8 (layer) exists in and blocks a gap between each developing roller 53 and its corresponding regulating plate 54.

As a result, even if each of the developing devices 5Y, 5M, 5C, and 5K is rotationally driven and operates at a relatively high speed, an abnormal increase in the internal pressure of the corresponding housing 50 is suppressed. By this, in each developing device 5, the air pressure difference between the accommodating chamber 50*a* of the housing 50 and the outside is reduced. Therefore, the phenomenon that the developer 8 (principally the toner) in each accommodating chamber 50*a* is scattered, enters the discharge path 50*j* of the discharge portion 50*d*, and is unexpectedly discharged from the discharge opening 50*i* is also suppressed.

In each of the developing devices 5Y, 5M, 5C, and 5K, as mentioned above, when part of the air that exists in the accommodating portion 50*a* of the housing 50 passes through the ventilation path portion 7 and is discharged to the outside of the housing 50, part of the developer 8 (actually, the toner) that is in the accommodating chamber 50*a* mixes with the air that is discharged, and is transported. Accordingly, this part of the developer 8 may be finally discharged to the gap space S (S2).

However, even in this case, each developer 8 that passes through the corresponding ventilation path portion 7 and is discharged to the gap space S (S2) along with the air is discharged from the exists 72A and 72B of the ventilation path portion 7 that are formed so as to face the end portions 53Ab and 53Ac corresponding to the effective non-development regions of the developing roller 53 (see FIG. 7). Therefore, each developer 8 that is discharged seldom moves towards the effective development region (that is, the region where the magnetic brushes are formed) of the developing roller 53. Accordingly, after each developer 8 has passed the development region that is close to and faces the photoconductor drum 21 substantially along the end portions 53Ab and 53Ac of the developing roller 53, each developer 8 is sucked in from the intake opening 28*a* by suction force of the intake path 28 (see FIG. 10). Thereafter, each developer 8 that has been sucked into the corresponding intake path 28 passes through the intake duct 102 from the terminal end portion 29 at the intake path 28, and is transported towards the intake device 101. When there is any developer 8 that has not been sucked into the intake path 28, part of such developer 8 may fall onto and be trapped by the developer trapping member 83 that exists below the intake opening 28*a* of the intake path 28.

Even if each developer 8 that is discharged flows so as to enter the effective development region at the developing roller 53 after being discharged from the exits 72A and 72B of the ventilation path portion 7, after such developer 8 has been trapped by a layer of developer 8 formed from magnetic brushes at an end portion of the effective development region, such developer 8 is transported by the rotation of the developing roller 53, and is used in development or passes the development region. Then, such developer 8 is returned to the accommodating chamber 50*a* of its corresponding housing 50.

However, in each of the developing devices 5Y, 5M, 5C, and 5K, even if the developer 8 that has passed through the ventilation path portion 7 is discharged from the gap space S (S2), such developer 8 that is discharged is principally sucked into the intake path 28. If not, such developer 8 is recovered by the developing roller 53, is returned to the accommodating chamber 50*a* of the housing 50, and is reused. By this, in each developing device 5, in particular, a filter for trapping the developer 8 that is discharged to the gap space S (S2) via the ventilation path portion 7 need not be provided at a portion of the housing 50.

Second Exemplary Embodiment

Figure 11:
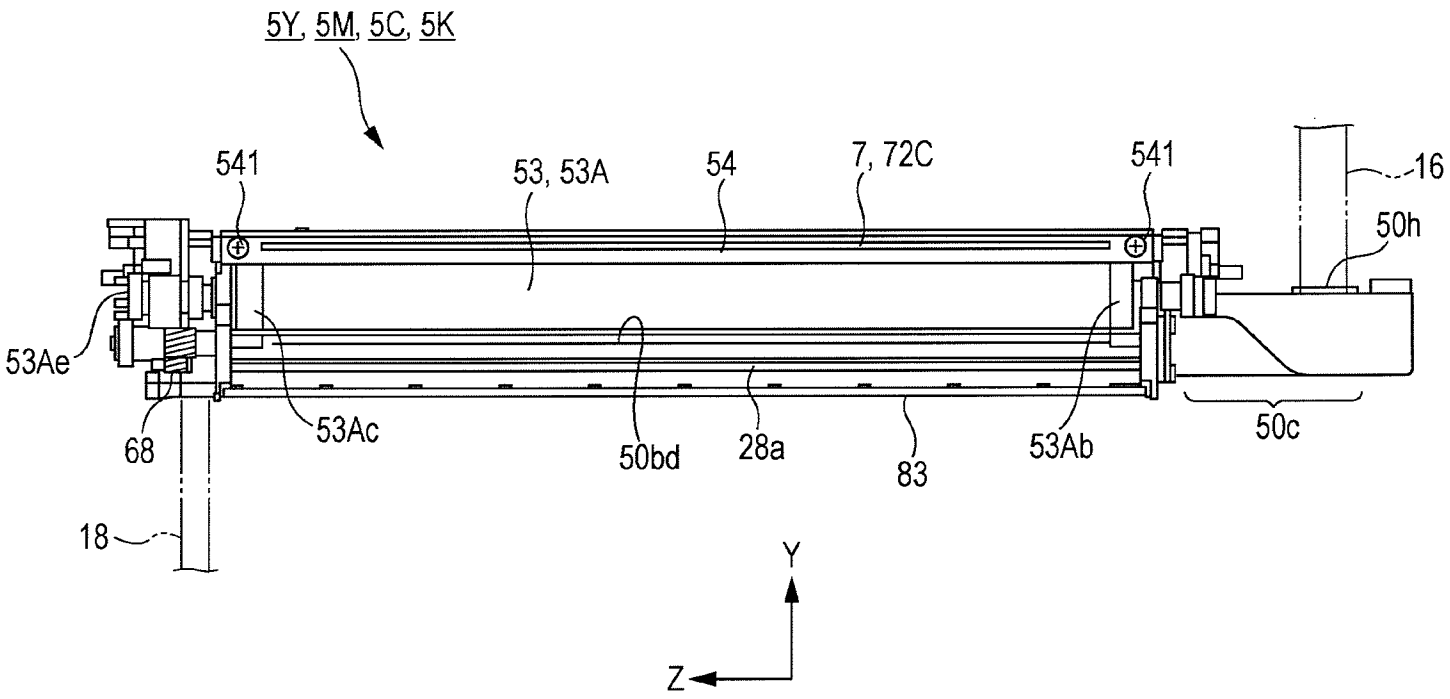
FIG. 11 is an explanatory view illustrating a state of a principal portion of a developing device according to a second exemplary embodiment when seen from a side of a developing roller.

FIG. 11 illustrates a developing device according to a second exemplary embodiment. Each of developing devices 5Y, 5M, 5C, and 5K according to the second exemplary embodiment has the same structure as the developing devices 5 according to the first exemplary embodiment except that an exit 72 of a ventilation path portion 7 differs.

In each of the developing devices 5Y, 5M, 5C, and 5*k* according to the second exemplary embodiment, as the exit 72 of the ventilation path portion 7, an exit 72C is formed in the form of a hole in a regulating plate 54 so as to continuously extend along a rotation axis direction of a developing roller 53. Each exit 72C is a long-and-narrow rectangular opening. The height of each exit 72 (dimension in a direction orthogonal to the rotation axis direction of the developing roller 53) is set in the range of, for example, approximately 1 to 2 mm. An entrance 71 of each ventilation path portion 7 in which the corresponding exit 72 is formed is an entrance that is similar to the entrances 71A and 71B of each ventilation path portion 7 in the first exemplary embodiment.

Even if the developing devices 5 according to the second exemplary embodiment are rotationally driven and operated at a relatively high speed, substantially similarly to the case of the developing devices 5 according to the first exemplary embodiment, part of the air that exists in an accommodating chamber 50*a* of each housing 50 flows into gap spaces S (S1 and S2) via the ventilation path portion 7, and, then, is discharged to the outside of the housing 50 (see, for example, FIG. 10), so that an abnormal increase in the internal pressure of each housing 50 is suppressed.

Even if, in each of the developing devices 5Y, 5M, 5C, and 5K, developer 8 is discharged to the gap space S (S2) via the ventilation path portion 7, substantially similarly to the case of the developing devices 5 according to the first exemplary embodiment, such developer 8 that is discharged is principally sucked into a corresponding intake path 28. If not, such developer 8 is recovered by the developing roller 53, is returned to the accommodating chamber 50*a* of the housing 50, and is reused.

In particular, in each of the developing devices 5, the exit 72C of the ventilation path portion 7 is formed as the aforementioned long-and-narrow rectangular opening. Therefore, developer substantially uniformly moves towards and contacts an effective development region (region where magnetic brushes are formed) of each developing roller 53, and tends to be uniformly trapped by the effective development region of the developing roller 53. By this, the developer 8 that is discharged from the exit 72 of each ventilation path portion 7 is uniformly recovered by the developing roller 53, and is effectively reused.

When a ventilation path portion 7 in which such an exit 72C is formed is used, developer 8 that is discharged via the ventilation path portion 7 tends to be properly trapped and recovered by the developing roller 53. Therefore, it is possible not to provide an intake path 28 in a developing device 5. In such a case, an intake duct 102 at an intake device 101 need not be disposed so as to be connected to the developing device 5.

Other Exemplary Embodiments

Although, in the first and second exemplary embodiments, developing devices 5 including rectifying members 58 are exemplified, the developing devices 5 need not include rectifying members 58. In this case, the entrances 71 of each ventilation path portion 7 may be disposed at a portion of the accommodating chamber 50*a* of the housing 50, and the path sections 73 that are connected to the exits 72 in the regulating plate 54 from the entrances 71 may be separately provided in the interior of the housing 50.

Although, in the first and second exemplary embodiments, the exits 72 of each ventilation path portion 7 are exemplified as being provided at two portions of the regulating plate 54 that face two end portions of the developing roller 53, an exit 72 of each ventilation path portion 7 may be provided at only one of the two portions.

The ventilation path portions 7 need not be provided such that two entrances and two exits are provided. For example, one entrance 71 and multiple exits 72 may be provided, or multiple entrances 71 and one exit 72 may be provided. In addition, if, as mentioned above, multiple entrances 71 and multiple exits 72 are provided, the same number of path sections 73 that cause the entrances 71 and the exits 72 to be connected to each other as the number of entrances 71 and exits 72 need not be separately provided. One common path section that causes the entrances 71 and the respective exits 72 to be connected to each other may be provided.

As long as the image forming apparatus that uses the developing devices according to the present invention is capable of using the developing devices, for example, the types thereof are not particularly limited to certain types. The number of developing devices that are used is also not particularly limited to certain numbers of developing devices.

The foregoing description of the exemplary embodiments of the present invention has been provided for the purposes of illustration and description. It is not intended to be exhaustive or to limit the invention to the precise forms disclosed. Obviously, many modifications and variations will be apparent to practitioners skilled in the art. The embodiments were chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. A developing device comprising:

a housing that includes an accommodating chamber, a development opening, and a discharge opening, the accommodating chamber accommodating developer, the development opening having its opening in an area of the accommodating chamber that faces a latent image holding member, part of the developer that is accommodated in the accommodating chamber overflowing into and being discharged from the discharge opening;

a developing roller that is provided in the housing, wherein the developing roller rotates with a portion of the developing roller being exposed from the development opening, the developing roller holding and transporting the developer that is supplied from the accommodating chamber;

a rotatable transporting member that is provided in the accommodating chamber of the housing, the rotatable transporting member transporting the developer in the accommodating chamber so as to supply the developer to the developing roller while stirring the developer;

a regulating member that regulates a thickness of a layer of the developer that is held by the developing roller by holding back part of the developer, the regulating member having a plurality of through holes, a portion of the accommodating chamber being a portion upstream, in a rotation direction of the developing roller, from the regulating member;

a ventilation path portion that is provided so as to extend through the plurality of through holes of the regulating member after extending to the regulating member from the portion of the accommodating chamber, the ventilation path portion reaching a gap space that exists between the developing roller and the housing in a range extending to the development opening from where the developing roller passes the regulating member;

a rectifying member that is disposed in the accommodating chamber and extends from the regulating member to at least a location above the rotatable transporting member so as to be separated from the developing roller, the rectifying member adjusting a flow of the developer that is held back by the regulating member and that is returned to a side where the rotatable transporting member is disposed; and a reinforcement member having at least one through hole, the reinforcement member being disposed between the rectifying member and a supporting member, wherein the rectifying member includes a plurality of through holes, wherein the ventilation path portion is provided so as to extend through the regulating member after reaching the regulating member from the rectifying member, wherein an end portion of the rectifying member is located at a position that corresponds to an end portion of the supporting member, and at least one through hole is disposed at the rectifying member adjacent to a connection point of the end portion of the supporting member and the end portion of the rectifying member; and wherein the ventilation path portion is connected to a space that is surrounded by the regulating member, a lower surface of the supporting member, and the rectifying member, by means of the plurality of through holes of the rectifying member which are aligned with the plurality of through holes of the regulating member, wherein leakage preventing members are provided at a location opposite the regulating member and are located at an upper surface of the supporting member, the upper surface contacting an inner surface of the housing, wherein the developing roller is positioned so as not to overlap with an area extended linearly from the plurality of through holes of the regulating member to an outside of the regulating member, and wherein the rectifying member directly contacts a surface of the regulating member.

2. The developing device according to claim 1, wherein an intake path having an intake opening is provided at a portion of the housing that is situated downstream in a rotation direction of the developing roller from a portion where the developing roller faces the latent image holding member.

3. An image forming apparatus comprising:

the developing device according to claim 1.

4. The image forming apparatus according to claim 3, further comprising an intake device that is connected to an intake path in the developing device.

* * * * *